US006785990B2

(12) United States Patent
Tomlin et al.

(10) Patent No.: US 6,785,990 B2
(45) Date of Patent: Sep. 7, 2004

(54) DEVICE FOR AND METHOD OF DISPLAYING MESSAGES

(76) Inventors: David A. Tomlin, 702 Village Castle Pl., Charleston, SC (US) 29414; Gordon H. Curtiss, 1335 Corley Ct., W. Columbia, SC (US) 29170

( * ) Notice: Subject to any disclaimer, the term of this patent is extended or adjusted under 35 U.S.C. 154(b) by 0 days.

(21) Appl. No.: 09/957,737

(22) Filed: Sep. 20, 2001

(65) Prior Publication Data

US 2002/0017044 A1 Feb. 14, 2002

Related U.S. Application Data

(60) Provisional application No. 60/222,163, filed on Aug. 1, 2000.

(51) Int. Cl.[7] ..... G09F 21/04; G09F 7/00

(52) U.S. Cl. ..... 40/463; 40/591; 40/601

(58) Field of Search ..... 40/591, 592, 593, 40/601, 610

(56) References Cited

U.S. PATENT DOCUMENTS

| | | | | | |
|---|---|---|---|---|---|
| 3,255,725 | A | * | 6/1966 | Von Kreidner et al. | 40/591 |
| 3,590,506 | A | * | 7/1971 | Jeski | 40/591 |
| 3,594,938 | A | * | 7/1971 | Mosch | 40/591 |
| 4,021,948 | A | * | 5/1977 | Mosch | 40/591 |
| 5,438,780 | A | * | 8/1995 | Winner | 40/591 |
| 5,760,695 | A | * | 6/1998 | Huber | 340/614 |

* cited by examiner

*Primary Examiner*—Cassandra H. Davis
(74) *Attorney, Agent, or Firm*—John D. Gugliotta; P. Jeff Martin

(57) ABSTRACT

A device for and method of displaying messages is provided which includes a portable control cabinet having electric power supplied externally. A timing device is provided which controls opening and closing of a hinged member, for example a car hood. The hinged member is attached with a visual display. A lifting device elevates the hinged member away from a lower surface to stretchably reveal display. A method of displaying a message is also provided.

14 Claims, 3 Drawing Sheets

DEVICE FOR AND METHOD OF DISPLAYING MESSAGES

CROSS-REFERENCES TO RELATED APPLICATIONS

This application claims the benefit of U.S. Provisional Application No. 60/222,163 Aug. 1, 2000, which provisional application is incorporated herein by reference.

STATEMENT REGARDING FEDERALLY SPONSORED RESEARCH OR DEVELOPMENT

Not Applicable.

BACKGROUND OF THE INVENTION

1. Field of the Invention

The present invention relates to a device for and method of displaying messages such as advertising information. The device comprises means for opening and closing a hinged member, such as the hood of a car, means of attaching the message to such hinged member and means of controlling the timing of the opening and closing of such hinged member, either through prior programming or through sensing of an event, such as a person walking past a car to the hood of which is attached the device. The method of displaying messages utilizes the device or similar devices to open and close hinged members in such manner as to catch the eye of those persons passing by the location where the devices are located thus drawing attention to the messages displayed thereby.

2. Description of the Related Art

There are known in the art many forms of message displays and eye catching devices which help ensure that persons passing by a location will see and take note of messages being displayed. Neon lights or search lights draw attention to a location and the messages, typically advertising, the proprietor wishes to impart. During all hours of the day banners and fixed signs impart the messages. Typically, it is movement which most attracts the human eye and thus incorporation of movement into displays helps assure that the message is received by even casual passers by. Large flags and strings of small, often triangular, flags attract attention as they blow in the breeze. Balloons over establishments also catch the eye both with movement and with the reaction of the viewer to a large object in what is normally clear air. Flashing lights can attract attention at all hours. Each of these devices and methods performs the intended function well enough, but such devices and methods are so common place that their effectiveness is diminished.

BRIEF SUMMARY OF THE INVENTION

It is the object of the present invention to provide a device which allows messages to be displayed with movement through the opening and closing of a hinged member, such as a car hood. Such device shall cause the hinged member to open either at pre-programmed times or upon the happening of an event. As an example the device could be set to open when the presence of a person is sensed in the vicinity of a device. A person viewing a given car at a car lot will walk up to that car. The device, sensing the person's presence then opens the hood of the car, revealing the message. Thus single displays can be provided at various places on any merchant's location, not just car lots, and such individual displays are opened by the device to impart the message to prospective customers as they walk by those particular locations. The random opening and closing of the displays resulting from this action will catch the attention of those walking or driving by the merchant's location, thus creating more interest in visiting such merchant's location. In the alternative the devices can be programmed to open and close at pre-set times. As an example on a car lot, a row of cars could be made to open sequentially to impart a message word by word, phrase by phrase, or letter by letter, from hood to hood. Again the resulting movement will attract attention from those walking or passing by the merchant's location, creating interest in visiting such merchant. It is further an object of this invention to provide a method of displaying messages in this manner using the device or similar devices.

BRIEF DESCRIPTION OF THE SEVERAL VIEWS OF THE DRAWINGS

The objects and features of the invention may be further understood with reference to the following detailed description of an illustrative embodiment of the invention taken together with the accompanying drawings in which.

DETAILED DESCRIPTION OF THE INVENTION

Figure 1:
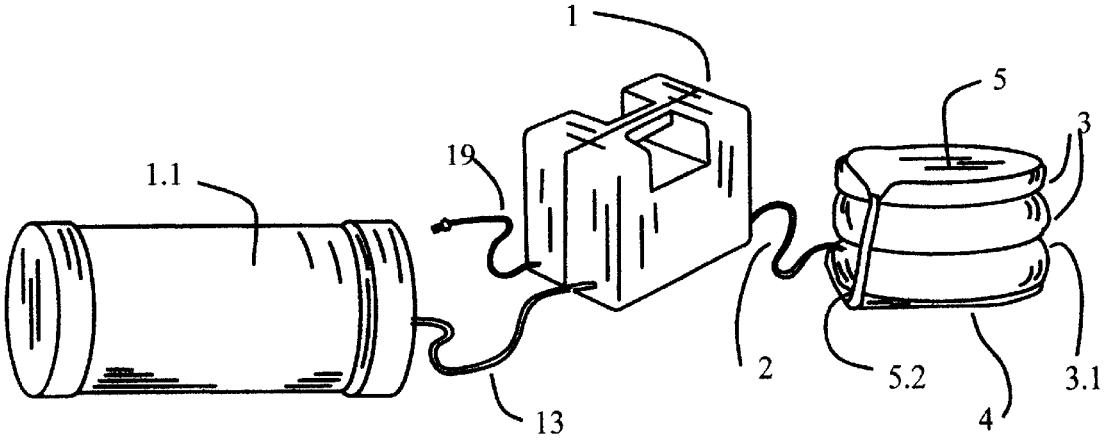
FIG. 1 shows an isometric view of the device attached to an air tank.

Turning now descriptively to the drawings in which similar reference characters denote similar elements throughout the several views, FIG. 1 shows the control unit 1 attached by an air supply hose 13 to an air tank 1.1. From said control unit 1 there extends an air bag air hose 2 which connects to the bottom air bag 3.1, said bottom air bag 3.1 having a lower surface and an upper surface. Also shown are the optional additional air bags 3, here shown two in number, each of which also has a lower surface and an upper surface. The upper surface of said bottom air bag 3.1 is attached in an air-tight fashion to the lower surface of the lower most of said optional additional air bags 3 and the upper surface of each of the lower of said optional additional air bags 3 is attached in an air-tight fashion to the lower surface of the next higher of said optional additional air bags 3. There is defined in the upper surface of said bottom air bag 3.1 and the lower surface of the lower most of said optional additional air bags 3 one or more holes which allow air communication between said bottom air bag 3.1 and the lower most of said optional additional air bags 3. There is defined in the upper surface of each of the lower of said optional additional air bags 3 and the lower surface of the next higher of said optional additional air bags 3 one or more holes which allow air communication between all of said optional additional air bags 3. Below said bottom air bag 3.1 lies the bottom abrasion pad 4, having a left front corner and a left back corner, and above the upper most of said optional additional air bags 3 is the top abrasion pad 5, having a left front corner and a left back corner. A front strap 5.1, having a bottom end and a top end, is inserted through a slit in the left front corner of said bottom abrasion pad 4 and tied at the bottom end of said front strap 5.1. Said front strap 5.1 is inserted through a slit in the left front corner of said top abrasion pad 5 and tied at the top end of said front strap 5.1. A back strap 5.2, having a bottom end and a top end, is inserted through a slit in the left back corner of said bottom abrasion pad 4 and tied at the bottom end of said back strap 5.2. Said back strap 5.2 is inserted through a slit in the left back corner of said top abrasion pad 5 and tied at the top end of said back strap 5.2.

Figure 2:
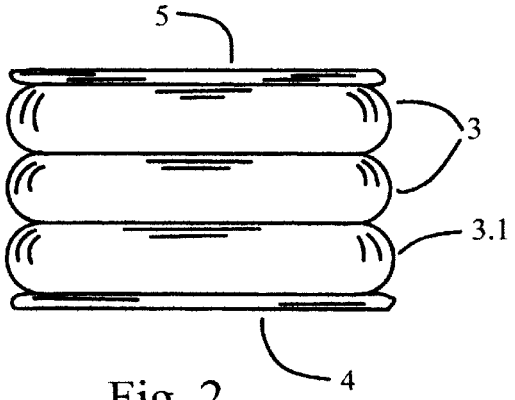
FIG. 2 shows a right side view of the surface lifting means portion of the device in the open position.

FIG. 2 shows a right side view of said bottom abrasion pad 4, lying below said bottom air bag 3.1., wherein said bottom air bag 3.1 is inflated placing the device in the open position. Above said bottom air bag 3.1 lie said optional additional air bags 3, here shown two in number, also inflated placing the device in the open position. Above the upper most of said optional additional air bags 3 lies said top abrasion pad 5.

Figure 3:
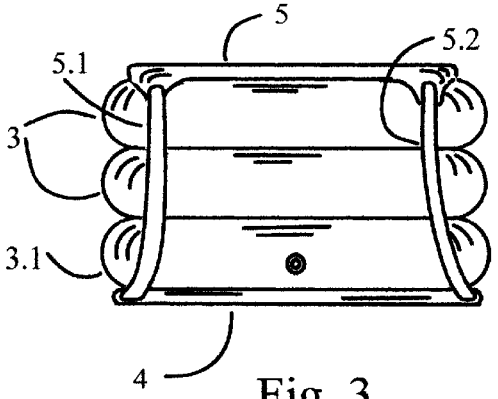
FIG. 3 shows a left side view of the surface lifting means portion of the device in the open position.

FIG. 3 shows a left side view of said bottom abrasion pad 4, lying below said bottom air bag 3.1., wherein said bottom air bag 3.1 is inflated placing the device in the open position. Above said bottom air bag 3.1 lie said optional additional air bags 3, here shown two in number, also inflated placing the device in the open position. Above the upper most of said optional additional air bags 3 lies said top abrasion pad 5. Such figure also shows front strap 5.1 and back strap 5.2 connecting said bottom abrasion pad 4 with said top abrasion pad 5 and shows the orifice defined in said bottom air bag 3.1 to allow air to be added to and taken from said bottom air bag 3.1 and also to any of said optional additional air bags 3 in communication with said bottom air bag 3.1.

Figure 4:
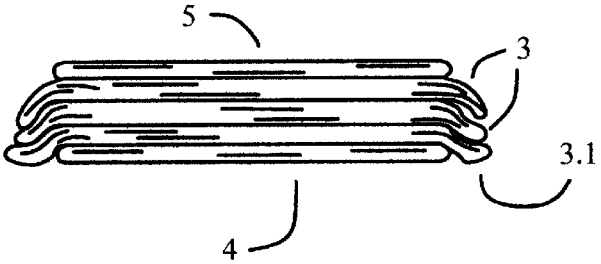
FIG. 4 shows a right side view of the surface lifting means portion of the device in the closed position.

FIG. 4 shows a right side view of said bottom abrasion pad 4, lying below said bottom air bag 3.1, wherein said bottom air bag 3.1 is deflated placing the device in the closed position. Above said bottom air bag 3.1 lie said optional additional air bags 3, here shown two in number, also deflated placing the device in the closed position. Above the upper most of said optional additional air bags 3 lies said top abrasion pad 5.

Figure 5:
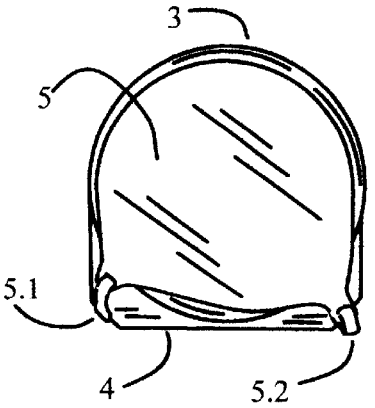
FIG. 5 shows a top view of the top abrasion pad lying over optional additional air bags.

FIG. 5 shows a top view of said top abrasion pad 5, lying over said optional additional air bags 3 and said bottom air bag 3.1 and shows front strap 5.1 and back strap 5.2 attached to said top abrasion pad 5 and to said bottom abrasion pad 4.

Figure 6:
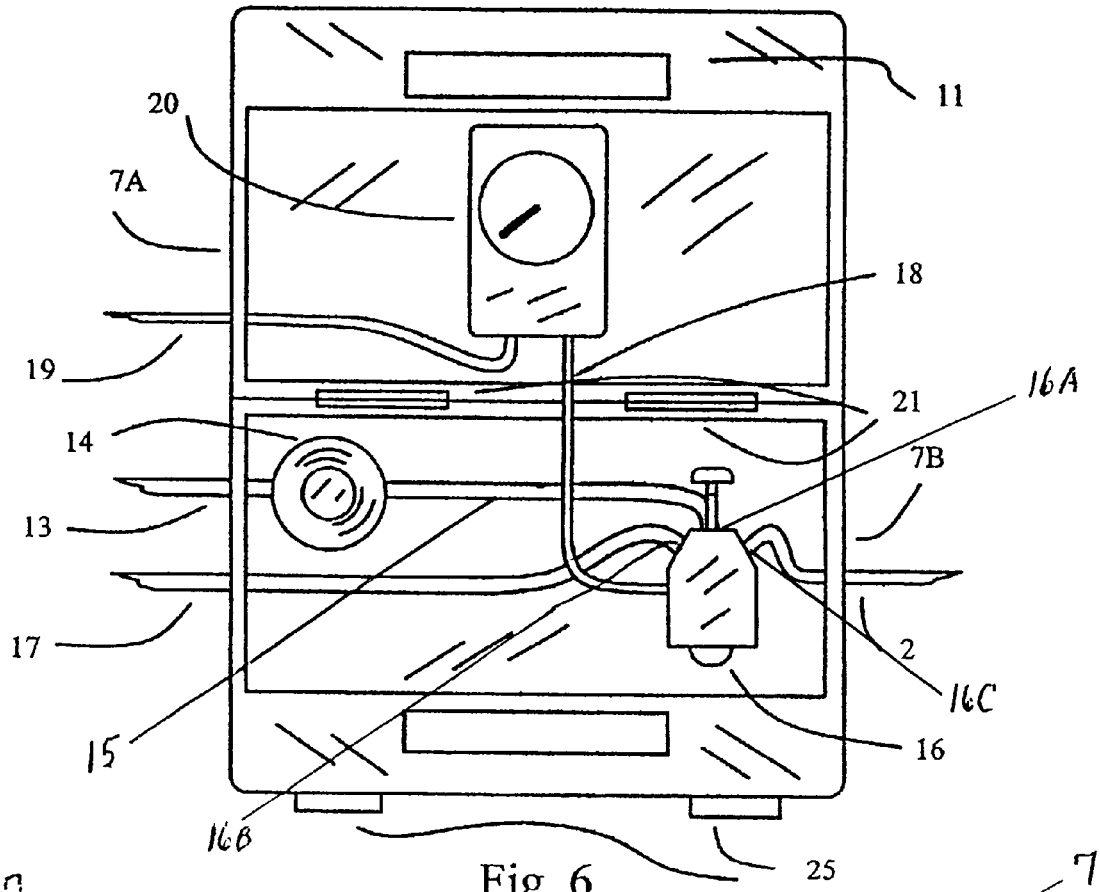
FIG. 6 shows a plan view of the interior of the control unit portion of the device.

FIG. 6 shows a plan view of the interior of said control unit 1. Shown are a case 7, having a front half 7A with a bottom surface and a back half 7B with a bottom surface, hinged longitudinally along the bottom surface of said front half 7A and the bottom surface of said back half 7B, upon which lie the various interior components. The air supply hose 13 enters said back half 7B and extends to an air pressure regulator 14, having an inlet and an outlet. A regulated air hose 15, having an inlet end and an outlet end, is attached at its inlet end to said air pressure regulator 14. Said regulated air hose 15 is attached at said outlet end to a solenoid valve 16 having a first opening 16A, a second opening 16B, and a third opening 16C, at said first opening 16A. Also attached to said solenoid valve 16 is an air discharge hose 17 attached at said second opening 16B. Said solenoid valve 16 receives electrical power for operation by a control circuit cord 18 which attaches said solenoid valve 16 to activating means 20 located in said front half 7A, which said activating means 20 is here shown as a cycle timing device. Said activating means 20 receives electrical power for operation from an electricity supply cord 19 located in said front half 7A. Attached to said solenoid valve 16 at said third opening 16C is said air bag air hose 2 which extends from said case back half 7B.

Figure 7:
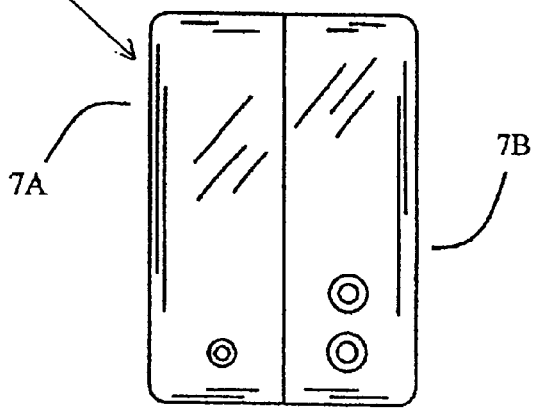
FIG. 7 shows a right side view of the exterior of the control unit portion of the device.

FIG. 7 shows a right side view of the exterior of said control unit 1 showing the right back side panel 10B of said case back half 7B and the right front side panel 10A of said case front half 7A. In said right back side panel 10B is defined a first orifice through which extends the inlet end of said air pressure regulator 14 and a second orifice through which extends said air discharge hose 17. In said right front side panel 10A is defined an orifice through which extends said electricity supply cord 19.

Figure 8:
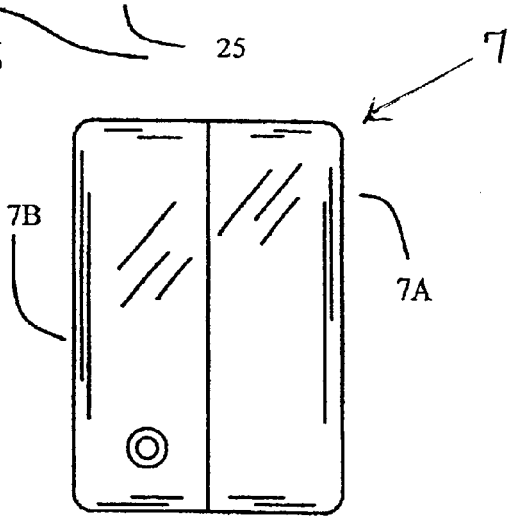
FIG. 8 shows a left side view of the exterior of the control unit portion of the device.

FIG. 8 shows a left side view of the exterior of said control unit 1 showing the left front side panel 9A of said case front half 7A and the left back side panel 9B of said case back half 7B. In said left back side panel 9B is defined an orifice through which extends said air bag air hose 2.

Figure 9:
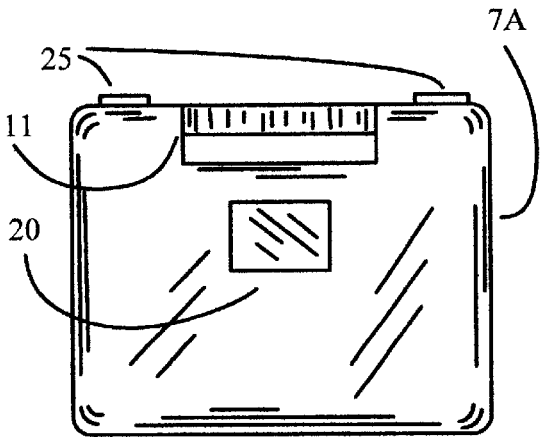
FIG. 9 shows a front side view of the exterior of the control unit portion of the device, including an optional orifice for placement of a motion sensing device.

FIG. 9 shows a front side view of the exterior of said control unit 1 showing said case front half 7A of said case 7 in which is defined an opening such that when said case front half 7A and said case back half 7B are closed a handle 11 is formed. Into said case front half 7A is defined an optional opening for said activating means 20, such that other activating devices, such as motion sensors, may be used instead of the cycle timing device shown in other figures.

Figure 10:
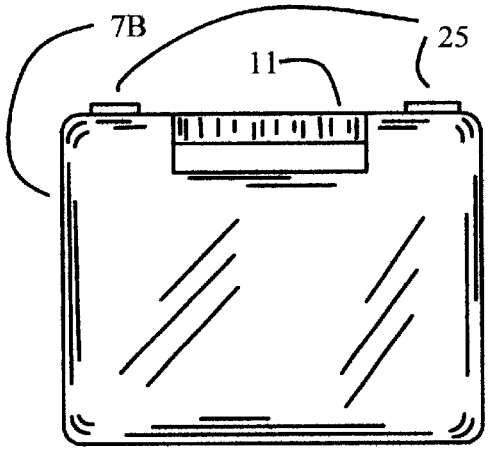
FIG. 10 shows a back side view of the exterior of the control unit portion of the device.

FIG. 10 shows a back side view of the exterior of said control unit 1 showing the case back half 7B of said case 7 in which is defined an opening such that when said case back half 7B and said case front half 7A are closed a handle 11 is formed.

Figure 11:
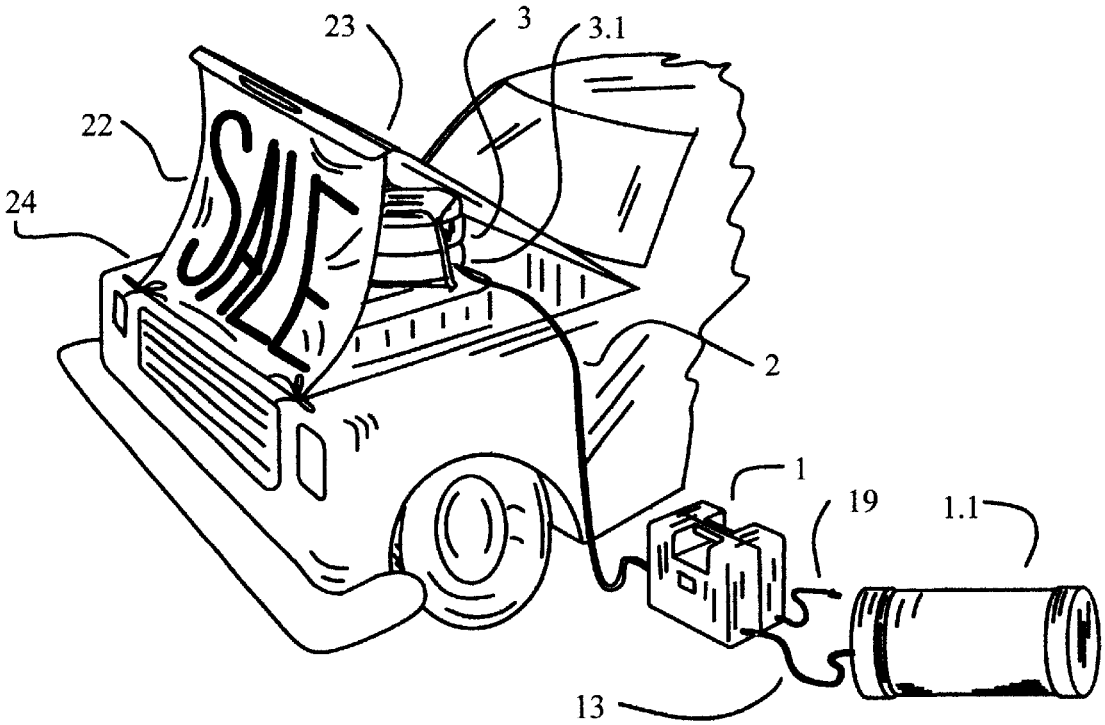
FIG. 11 shows the device as attached to a car to open and close the hood thereof and shows a vissual display with message attached to such hood.

FIG. 11 shows the device in use with a lower surface 24, here shown as an automobile engine area. Said lower surface 24 is located under an upper surface 23, here shown as the automobile hood. Under the upper surface 23 lie the top abrasion pad 5, said optional additional air bags 3, here shown two in number, said bottom air bag 3.1 and said bottom abrasion pad 4, all of which lie on top of said lower surface 24. To said upper surface 23 is attached a visual display 22 such that when said bottom air bag 3.1 and said optional additional air bags 3 are inflated and the device is in the open position, said upper surface 23 is open and said visual display 22 shows; and when said bottom air bag 3.1 and said optional additional air bags 3 are deflated and the device is in the closed position, said upper surface 23 is closed and said visual display 22 does not show. To said bottom air bag 3.1 is attached said air bag air hose 2. Said air bag air hose 2 is attached to said control unit 1. Upon said control unit 1 is the optional orifice allowing insertion as the activating means 20 of activating devices other than the cycle timing device shown in other figures, such as a motion sensor. From said control unit 1 extend said air supply hose 13 to an air tank 1.1 and said electricity supply cord 19.

While I have described and illustrated certain embodiments of my invention, it is to be understood that further modifications and improvements are contemplated and may be practiced without departing in any way from the spirit of the invention, for the limits of which reference must be had to the appended claims

We claim:

1. A device for displaying messages which comprises:

a. a control unit which comprises:

i. a case, said case having a front half and a back half;

ii. an electricity supply cord adapted for connection to a standard wall socket providing electric power to a portable control cabinet and extending into said case;

iii. an activating means, said activating means located within said case to which is attached said electricity supply cord;

iv. an air pressure regulator, said air pressure regulator located within said case, having an inlet and an outlet, said inlet extending through said case for attachment thereto of an air supply hose for supply of air from an air tank;

v. a regulated air hose, said regulated air hose located within said case, having an inlet end and an outlet end, connected at said inlet end to said outlet of said air pressure regulator;

vi. a solenoid valve, said solenoid valve located within said case, having a first opening, a second opening and a third opening, constructed such that when electricity is provided to said solenoid valve, said first opening and said third opening communicate and when electricity is not provided to said solenoid valve, said second opening and said third opening communicate, to said first opening is attached said outlet end of said regulated air hose;

vii. an air discharge hose, said air discharge hose attached to said second opening of said solenoid valve;

viii. an air bag air hose, said air bag air hose having a unit end and a bag end, said unit end being attached to said third opening of said solenoid valve;

ix. a control circuit cord, said control circuit cord attached to said activation means and to said solenoid valve carrying electricity from said activation means to said solenoid valve;

b. a surface lifting device, said surface lifting device is placed upon a lower surface below an upper surface which comprises a bottom air bag attached to said bag end of said air bag air hose; and c. a visual display, said visual display is attached to said lower surface and said upper surface such that when said surface lifting device is activated said visual display is visible and stretched from said lower surface to said upper surface.

2. A device as recited in claim 1, wherein said surface lifting device further comprises:

a. a plurality of additional air bags, each of which is stacked atop one another and atop said bottom air bag;

b. means for allowing air to flow from said bottom air bag into and out of each of said additional air bags and said bottom air bag;

c. a bottom abrasion pad, having a right front corner and a right back corner, located between said bottom air bag and said lower surface;

d. a top abrasion pad having a right front corner and a right back corner, located between said additional air bags and said upper surface;

e. a front strap tying the right front corner of said bottom abrasion pad to the right front corner of said top abrasion pad; and f. a back strap tying the right back corner of said bottom abrasion pad to the right back corner of said top abrasion pad.

3. A device as recited in claim 2, wherein said additional air bags number two.

4. A device as recited in claim 1, wherein said activation means comprises a standard electrical device cycle timer.

5. A device as recited in claim 4, wherein said surface lifting device further comprises:

a. a plurality of additional air bags, each of which is stacked atop one another and atop said bottom air bag;

b. means for allowing air to flow from said bottom air bag into and out of each of said additional air bags and said bottom air bag;

c. a bottom abrasion pad, having a right front corner and a right back corner, located between said bottom air bag and said lower surface;

d. a top abrasion pad, having a right front corner and a right back corner, located between said additional air bags and said upper surface;

e. a front strap tying the right front corner of said bottom abrasion pad to the right front corner of said top abrasion pad; and f. a back strap tying the right front corner of said bottom abrasion pad to the right back corner of said top abrasion pad.

6. A device as recited in claim 5, wherein said additional air bags number two.

7. A device as recited in claim 1, wherein said activation means comprises a motion sensor and there is defined in said case an orifice through which said motion sensor extends.

8. A device as recited in claim 7, wherein said surface lifting device further comprises:

a. a plurality of additional air bags, each of which is stacked atop one another and atop said bottom air bag;

b. means for allowing air to flow from said bottom air bag into and out of each of said additional air bags and said bottom air bag;

c. a bottom abrasion pad, having a right front corner and a right back corner, located between said bottom air bag and said lower surface;

d. a top abrasion pad, having a right front corner and right back corner, located between said additional air bags and said upper surface;

e. a front strap tying the right front corner of said bottom abrasion pad to the right front corner of said top abrasion pad; and f. a back strap tying the right back corner of said bottom abrasion pad to the right back corner of said top abrasion pad.

9. A device as recited in claim 8, wherein said additional air bags number two.

10. A device as recited in claim 8, wherein said additional air bags number two.

11. A method of displaying a message, comprising the steps of:

(1) placing a message upon a sheet of collapsible material, wherein said sheet having an upper edge and a lower edge;

(2) connecting said sheet at said lower edge of said sheet to a front edge of a lower surface;

(3) connecting said sheet at said upper edge of said sheet to a front edge of an upper surface;

(4) connecting a back edge of said lower surface to a back edge of said upper surface in a hinged manner;

(5) placing an elevating means in between said lower surface and said upper surface and behind said sheet in order to elevate said front edge of said upper surface away from said front edge of said lower surface, thereby stretching said sheet to reveal said message; and (6) controlling said elevating means by a control means.

12. The method of claim 11, wherein said elevating means comprises a bottom air bag being attached to said control means via an air bag air hose, and wherein said control means comprises:

a case, said case having a front half and a back half defining a portable control cabinet;

an electricity supply cord, said electricity supply cord being adapted for connection to a standard wall socket which provides electric power to said portable control cabinet, and wherein said electricity supply cord extends into said case;

an activating means, said activating means is located within said case, and wherein said activating means has said electricity supply cord attached thereto;

an air pressure regulator, said air pressure regulator is located within said case, said air pressure regulator having an inlet and an outlet, wherein said inlet extends through said case and is attached to an air supply hose for supplying air from an air tank;

a regulated air hose, said regulated air hose is located within said case, said regulated air hose having an inlet end and an outlet end, said inlet end of said regulated air hose is connected to said outlet of said air pressure regulator;

a solenoid valve, said solenoid valve is located within said case, said solenoid valve has a first opening, a second opening and a third opening, wherein said first opening is attached to said outlet end of said regulated air hose, and wherein said first opening, said second opening, and said third opening are constructed in a manner such that when electricity is supplied to said solenoid valve, said first opening and said third opening communicate, and when said solenoid valve is not supplied with electricity, said second opening and said third opening communicate;

an air discharge hose, said air discharge hose is attached to said second opening of said solenoid valve;

an air bag air hose, said air bag air hose has a unit end and a bag end, wherein said unit end is attached to said third opening of said solenoid valve; and a control circuit cord, said control circuit cord electrically connecting said activating means to said solenoid valve, wherein said control circuit cord transmitting electricity from said activating means to said solenoid valve.

13. The method of claim 12, wherein said elevating means further comprises:

a plurality of additional air bags, wherein each of said plurality of additional air bags being stacked atop one another and stacked atop said bottom air bag;

an air bag air communication means, said air bag air communication means for allowing air to flow from said bottom air bag into and out of each of said plurality of additional air bags and said bottom air bag;

a bottom abrasion pad, said bottom abrasion pad has a right front corner and a right back corner, said bottom abrasion pad is located between said bottom air bag and said lower surface;

a top abrasion pad, said top abrasion pad has a right front corner and a right back corner, said top abrasion pad is located between said plurality of additional air bags and said upper surface;

a front strap, said front strap ties said right front corner of said bottom abrasion pad to said right front corner of said top abrasion pad; and a back strap, said back strap ties said right back corner of said bottom abrasion pad to said right back corner of said top abrasion pad.

14. The method of claim 13, wherein said lower surface is an engine area of a vehicle and said upper surface is a hood of the vehicle.

* * * * *